US008708461B2

(12) United States Patent
Chung et al.

(10) Patent No.: US 8,708,461 B2
(45) Date of Patent: Apr. 29, 2014

(54) THERMAL RESISTOR FLUID EJECTION ASSEMBLY

(75) Inventors: Bradley D. Chung, Corvallis, OR (US); Galen P. Cook, Albany, OR (US); Daniel Fradl, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/703,370

(22) PCT Filed: Jul. 23, 2010

(86) PCT No.: PCT/US2010/043123

§ 371 (c)(1), (2), (4) Date: Dec. 11, 2012

(87) PCT Pub. No.: WO2012/011923

PCT Pub. Date: Jan. 26, 2012

(65) Prior Publication Data

US 2013/0083131 A1 Apr. 4, 2013

(51) Int. Cl.
*B41J 2/05* (2006.01)

(52) U.S. Cl.
USPC ..... 347/62

(58) Field of Classification Search
USPC ..... 347/20, 44, 47, 54, 56, 61–65, 67
See application file for complete search history.

(56) References Cited

U.S. PATENT DOCUMENTS

| | | | | |
|---|---|---|---|---|
| 5,376,773 | A | 12/1994 | Masuda et al. | |
| 5,600,356 | A * | 2/1997 | Sekiya et al. | 347/62 |
| 6,354,695 | B1 | 3/2002 | Kim et al. | |
| 6,540,325 | B2 | 4/2003 | Kawamura et al. | |
| 6,832,434 | B2 | 12/2004 | Rausch et al. | |
| 6,911,627 | B2 | 6/2005 | Oguma et al. | |
| 7,057,143 | B2 | 6/2006 | Sakamoto et al. | |
| 2009/0015639 | A1 | 1/2009 | Fukui et al. | |
| 2009/0033719 | A1 | 2/2009 | Saikawa et al. | |
| 2009/0040257 | A1 | 2/2009 | Bergstedt et al. | |

FOREIGN PATENT DOCUMENTS

| | | | | |
|---|---|---|---|---|
| JP | 1988-191644 | | 8/1988 | |
| JP | 1988-202455 | | 8/1988 | |
| JP | 4113851 | * | 4/1992 | 347/62 |
| JP | 6134988 | * | 5/1994 | 347/56 |
| JP | 1994-198914 | | 7/1994 | |
| JP | 1994-320735 | | 11/1994 | |
| JP | 8169116 | | 7/1996 | |
| JP | 1996-300660 | | 11/1996 | |
| JP | 10016221 | | 1/1998 | |
| JP | 1998-044413 | | 2/1998 | |
| JP | 2000-272130 | | 10/2000 | |
| JP | 2002-036558 | | 2/2002 | |
| JP | 2002-067321 | | 3/2002 | |
| JP | 2002-211013 | | 7/2002 | |
| JP | 2003-211672 | | 7/2003 | |
| JP | 2006001016 | | 1/2006 | |
| KR | 20080006115 | | 7/2008 | |

* cited by examiner

*Primary Examiner* — Juanita D Jackson

(74) *Attorney, Agent, or Firm* — Nathan R. Rieth

(57) ABSTRACT

A thermal resistor fluid ejection assembly includes an insulating substrate and first and second electrodes formed on the substrate. A plurality of individual resistor elements of varying widths are arranged in parallel on the substrate and electrically coupled at a first end to the first electrode and at a second end to the second electrode.

20 Claims, 9 Drawing Sheets

THERMAL RESISTOR FLUID EJECTION ASSEMBLY

BACKGROUND

An inkjet printing device is an example of a fluid ejection device that provides drop-on-demand (DOD) ejection of fluid droplets. In conventional DOD inkjet printers, printheads eject fluid droplets (e.g., ink) through a plurality of nozzles toward a print medium, such as a sheet of paper, to print an image onto the print medium. The nozzles are generally arranged in one or more arrays, such that properly sequenced ejection of ink from the nozzles causes characters or other images to be printed on the print medium as the printhead and the print medium move relative to one other.

One example of a DOD inkjet printer is a thermal inkjet (TIJ) printer. In a TIJ printer, a printhead includes a resistor heating element in a fluid-filled chamber that vaporizes fluid, creating a rapidly expanding bubble that forces a fluid droplet out of a printhead nozzle. Electric current passing through the heating element generates the heat, vaporizing a small portion of the fluid within the chamber. As the heating element cools the vapor bubble collapses, drawing more fluid from a reservoir into the chamber in preparation for ejecting another drop through the nozzle.

Unfortunately, thermal and electrical inefficiencies in the firing mechanism of the TIJ printhead (i.e., super-heating the fluid to form a vapor bubble) present a number of disadvantages that increase costs and reduce overall print quality in TIJ printers. One disadvantage, for example, is a decrease in firing performance over the life of the inkjet pen caused by a buildup of residue (koga) on the firing surface of the resistor heating element. Another disadvantage, when increasing the rate of drop ejection or firing speed (e.g., to increase image resolution while maintaining printed page throughput), is that the printhead can overheat, causing a vapor lock condition that prevents further firing and potential damage to the printhead. Another disadvantage is that the large electronic devices and power busses that drive thermally inefficient resistor heating elements take up costly silicon space in the TIJ printhead.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
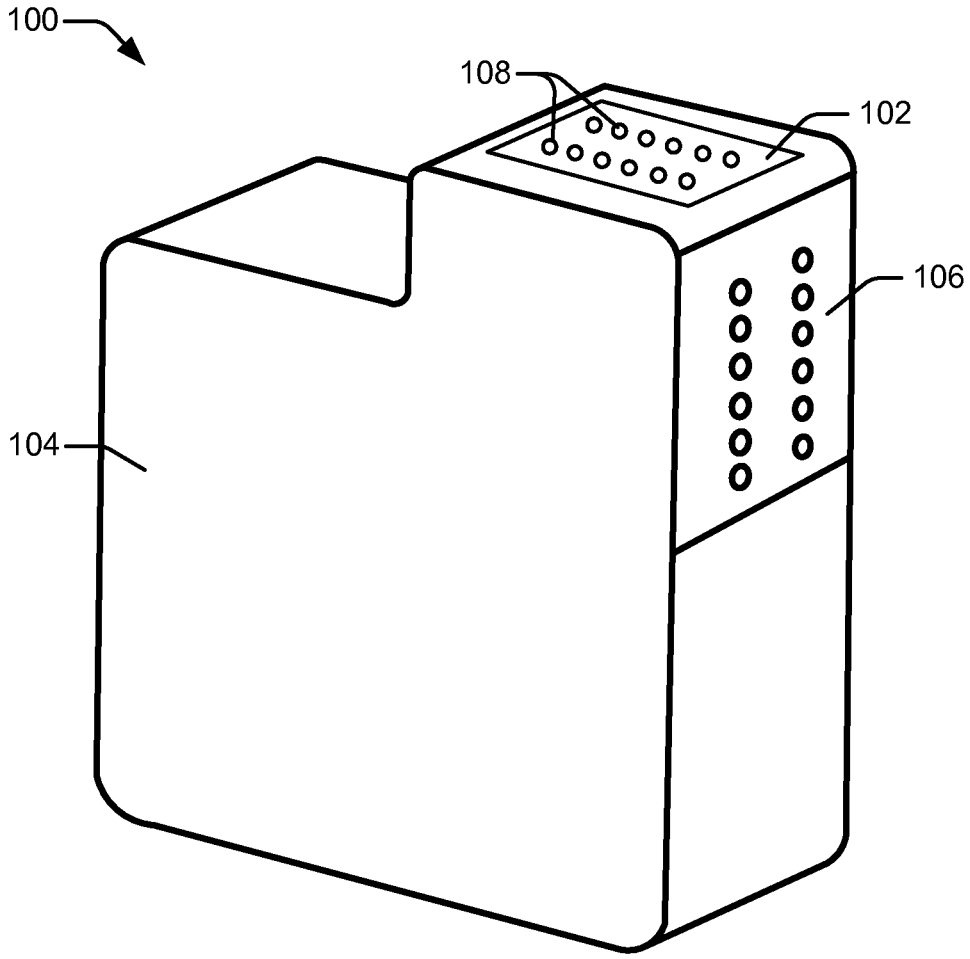
FIG. 1 shows an example of an inkjet pen suitable for incorporating a fluid ejection assembly, according to an embodiment.

As noted above, thermal inkjet (TIJ) devices suffer various disadvantages generally associated with thermal and electrical inefficiencies in the TIJ printhead firing mechanism. The thermal and electrical inefficiencies are represented, more specifically, as temperature non-uniformity across the nucleation surface of the TIJ resistor heating element (i.e., the resistor/fluidic interface where vapor bubble formation occurs) which results in a need to deliver greater energy to the heating element. Increasing firing energy to the TIJ resistor heating element to overcome the temperature non-uniformity problem, however, causes various other problems.

One such problem impacts the fluid drop ejection rate (i.e., firing speed) in the TIJ printhead. A higher ejection rate is beneficial because it provides for increased image resolution, faster page throughput, or both. However, inefficiencies in the transfer of energy from the nucleation surface of the TIJ resistor heating element to the fluid (e.g., ink) result in residual heat that increases the temperature of the printhead. Increasing the drop ejection rate increases the amount of energy being delivered through the heating element over a given period of time. Therefore, additional residual heat created by increasing the drop ejection rate causes a corresponding increase in printhead temperature, which ultimately causes a vapor lock condition (over-heating) that prevents further firing and potential damage to the printhead. Accordingly, the inefficient transfer of energy from the surface of the resistor heating element to the ink results in the need to limit or pace the drop ejection rate, which is a significant disadvantage, for example, in the high speed publishing market.

The inefficient transfer of energy from the surface of the TIJ resistor heating element to the ink also increases the overall cost of inkjet printing systems. Large FETs and power busses are needed to deliver increased energy to drive large banks of thermally inefficient TIJ resistors. The larger devices and busses not only occupy valuable silicon space, but their associated electrical parasitics also ultimately limit the amount of printhead die shrink. Thus, the larger silicon footprint needed to support inefficient TIJ resistors means silicon continues to be a significant percentage of the overall cost of many inkjet printing systems.

Increasing the firing energy to the TIJ resistor to overcome temperature non-uniformity across its nucleation surface also creates another problem related to the resulting higher temperatures at the surface of the TIJ resistor. Although an overall increase in temperature at the nucleation surface maintains certain desired characteristics of the ejected fluid droplet, such as drop weight, drop velocity, drop trajectory, and drop shape, it also has the adverse effect of increasing kogation.

Kogation is the buildup of residue (koga) on the surface of the resistor. Over time, kogation adversely impacts fluid drop characteristics such as drop weight, drop velocity, drop trajectory, and drop shape, and it ultimately decreases the overall print quality in a TIJ printing system.

Prior solutions to the problems of thermal inefficiency and non-uniformity in TIJ resistor heating elements have included altering both the TIJ resistor and the ejection fluid (ink). However, such solutions have disadvantages. For example, a suspended resistor design allows heating from both sides of a thin film resistor immersed in the fluid, improving heat/energy transfer efficiency by increasing the amount of resistor surface area exposed to the fluid. However, the fragile thin film beam may be unreliable when exposed to the violent nucleation events during drop ejection and requires specialized fabrication processes that increase costs. Another example is a donut shaped resistor having a center-zone removed which purportedly improves resistor efficiency and removes the hot spot common to TIJ resistors. However, the electrical path length variation fundamental to the curved "donut" geometry results in current crowding and current density uniformity issues, which ultimately lead to hot spots that cause temperature non-uniformity across the resistor. Prior solutions to the problem of kogation have primarily involved adjusting the ink formulation to determine chemical combinations that are less reactive over the life of the printhead. However, this solution can significantly increase cost while narrowing the availability of fluids/inks available for use in TIJ printheads which ultimately limits the printing markets available to TIJ printing systems.

Embodiments of the present disclosure help to overcome disadvantages in TIJ devices (e.g., thermal and electrical inefficiencies) related to temperature non-uniformity across the nucleation surface of the TIJ resistor, generally, through a TIJ resistor structure that uses multiple resistor elements running in parallel whose widths and spacing are individually set to achieve temperature uniformity across the nucleation surface. The resulting TIJ resistor structure is a three-dimensional structure with recesses, or channels, formed between individual ridges, or "comb teeth". The three-dimensional surface and the variable widths and spacing of resistor elements contribute to an improved temperature uniformity across the nucleation surface of the TIJ resistor, as well as an increase in the nucleation surface area per unit area of resistor material. The larger nucleation surface area and improved temperature uniformity across the nucleation surface significantly improve the efficiency of energy or heat transfer between the TIJ resistor structure and the fluid. The improved thermal efficiency and uniformity, in turn, reduce the amount of energy needed to eject each drop of fluid, which results in numerous benefits including, for example, the ability to increase fluid drop ejection rates without causing a vapor lock condition, the ability to reduce FET and power bus widths enabling more aggressive die shrink and lower silicon costs, and reduced kogation which improves drop ejection performance over the lifetime of the TIJ printhead.

In one example embodiment, a thermal resistor fluid ejection assembly includes an insulating substrate with first and second electrodes formed on the substrate. A plurality of individual resistor elements having varying widths are arranged in parallel on the substrate and are electrically coupled at a first end to the first electrode and at a second end to the second electrode.

In another embodiment, a fluid ejection device includes a fluid ejection assembly having a resistor structure with a plurality of resistor elements. The resistor structure has formed as a top layer, an uneven nucleation surface having protruding ridges separated by recessed channels to vaporize fluid when heated by the resistor elements. The width of each protruding ridge corresponds with an associated resistor element underlying the nucleation surface.

In another embodiment, a thermal resistor structure includes a plurality of resistor elements coupled in parallel and having non-uniform widths. There is a space between every two resistor elements. A thin film cavitation layer is formed over the resistor elements and the spaces such that a ridge is formed over each resistor element and a channel is formed over each space, with the cavitation layer forming a nucleation surface to transfer heat from the resistor elements to vaporize fluid in a chamber and eject a fluid drop from the chamber.

Illustrative Embodiments

FIG. 1 shows an example of an inkjet pen 100 suitable for incorporating a fluid ejection assembly 102 as disclosed herein, according to an embodiment. In this embodiment, the fluid ejection assembly 102 is disclosed as a fluid drop jetting printhead 102. The inkjet pen 100 includes a pen cartridge body 104, printhead 102, and electrical contacts 106. Individual fluid drop generators 200 (e.g., see FIG. 2) within printhead 102 are energized by electrical signals provided at contacts 106 to eject droplets of fluid from selected nozzles 108. The fluid can be any suitable fluid used in a printing process, such as various printable fluids, inks, pre-treatment compositions, fixers, and the like. In some examples, the fluid can be a fluid other than a printing fluid. The pen 100 may contain its own fluid supply within cartridge body 104, or it may receive fluid from an external supply (not shown) such as a fluid reservoir connected to pen 100 through a tube, for example. Pens 100 containing their own fluid supplies are generally disposable once the fluid supply is depleted.

Figure 2A:
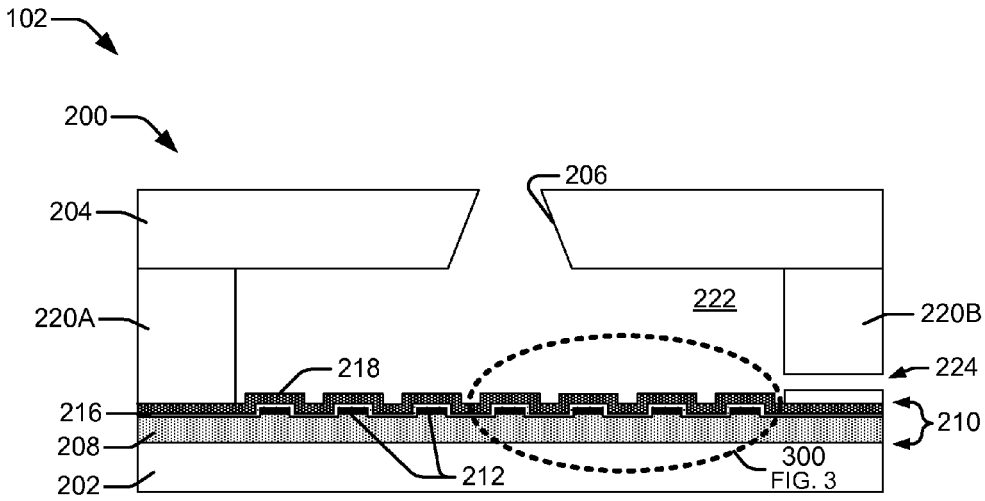
FIG. 2A shows a cross-sectional view of a partial fluid ejection assembly, according to an embodiment.
Figure 2B:
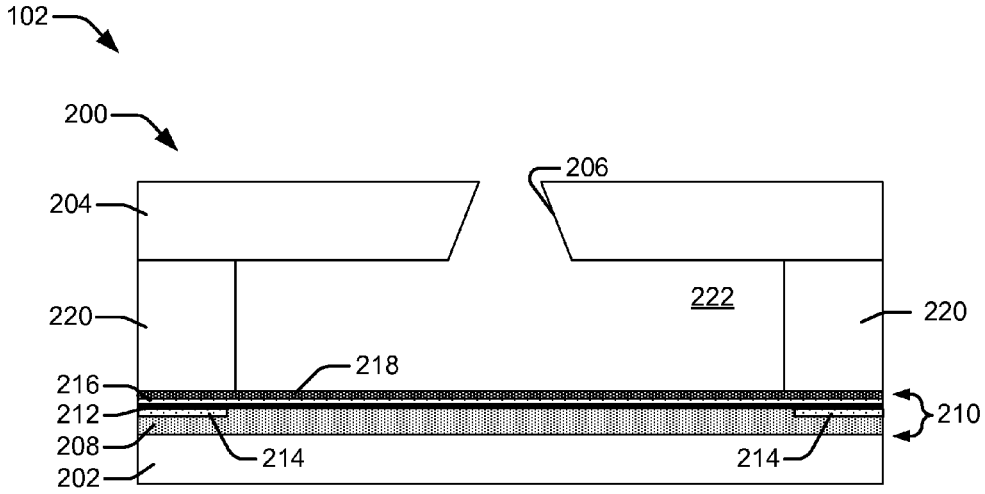
FIG. 2B shows a cross-sectional view of the partial fluid ejection assembly of FIG. 2A, rotated 90 degrees, according to an embodiment.

FIG. 2A shows a cross-sectional view of a partial fluid ejection assembly 102, according to an embodiment of the disclosure. FIG. 2B shows a cross-sectional view of the same partial fluid ejection assembly 102 of FIG. 2A, rotated 90 degrees, according to an embodiment of the disclosure. The partial fluid ejection assembly 102 is shown as an individual fluid drop generator assembly 200. The drop generator assembly 200 includes a rigid floor substrate 202 and a rigid (or flexible) top nozzle plate 204 having a nozzle outlet 206 through which fluid droplets are ejected. The substrate 202 is typically a silicon substrate that has an oxide layer 208 on its top surface. A thin film stack 210 generally includes an oxide layer, a metal layer defining a plurality of individual resistor heating/firing elements 212, conductive electrode traces 214 (FIG. 2B), a passivation layer 216, and a cavitation layer 218 (e.g., tantalum). The thin film stack 210 forms a three-dimensional resistor structure 300 with recesses, or channels, formed between individual ridges, or "comb teeth", as discussed in greater detail with regard to FIGS. 3 through 8.

The fluid drop generator assembly 200 also includes a number of sidewalls such as sidewalls 220A and 220B, collectively referred to as sidewalls 220. The sidewalls 220 separate the substrate floor 202 from the nozzle plate 204. The substrate floor 202, the nozzle plate 204, and the sidewalls 220 define a fluid chamber 222 that contains fluid to be ejected as fluid droplets through the nozzle outlet 206. Sidewall 220B has a fluid inlet 224 to receive the fluid that eventually gets ejected as droplets through nozzle outlet 206. The placement of fluid inlet 224 is not limited to sidewall 220B. In different embodiments, for example, fluid inlet 224 may be placed in other sidewalls 208 or in the substrate floor 202, or it may comprise multiple fluid inlets placed in various sidewalls 220 or in the substrate 202.

Figure 2C:
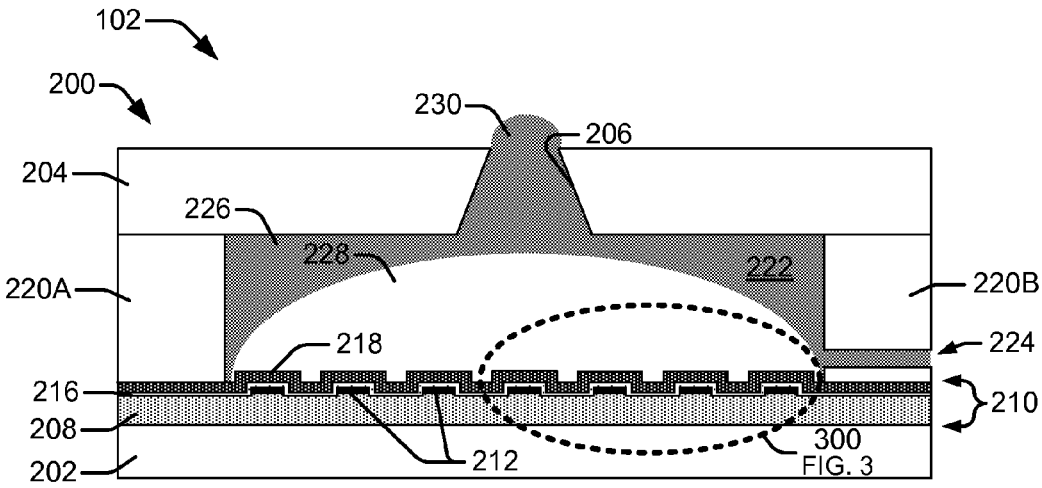
FIG. 2C shows a cross-sectional view of a partial fluid ejection assembly during operation, according to an embodiment.
Figure 2D:
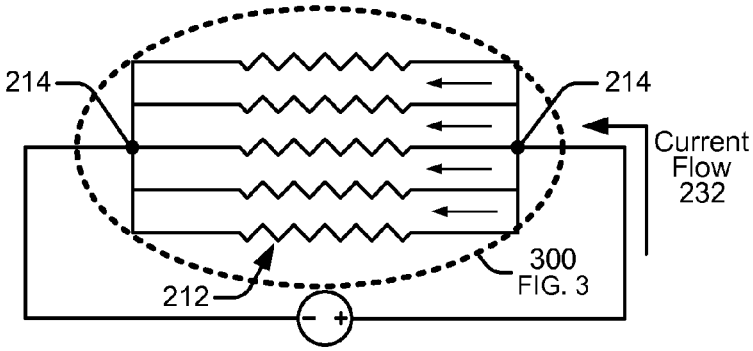
FIG. 2D shows resistor heating elements electrically coupled in parallel in a partial electrical circuit, according to an embodiment.

FIG. 2C shows a cross-sectional view of a partial fluid ejection assembly 102 during operation, according to an embodiment of the disclosure. During operation, the drop generator 200 ejects droplets of fluid 226 through nozzle 206 by passing electrical current through resistor elements 212. The individual resistor heating elements 212 are electrically coupled in parallel between conductive electrode traces 214 as generally shown in the partial electrical circuit diagram of FIG. 2D. The current 232 passing through resistor elements 212 generates heat and vaporizes a small portion of the fluid 226 at the surface of the resistor structure 300 (i.e., the tantalum cavitation layer 218/fluidic interface proximate to resistor heating elements 212 where vapor bubble formation occurs) within firing chamber 222. When a current pulse is supplied, the heat generated by the resistor elements 212 creates a rapidly expanding vapor bubble 228 that forces a small fluid droplet 230 out of the firing chamber nozzle 206. When the resistor elements 212 cool, the vapor bubble quickly collapses, drawing more fluid 226 through inlet 224 into the firing chamber 222 in preparation for ejecting another drop 226 from the nozzle 206.

Figure 3:
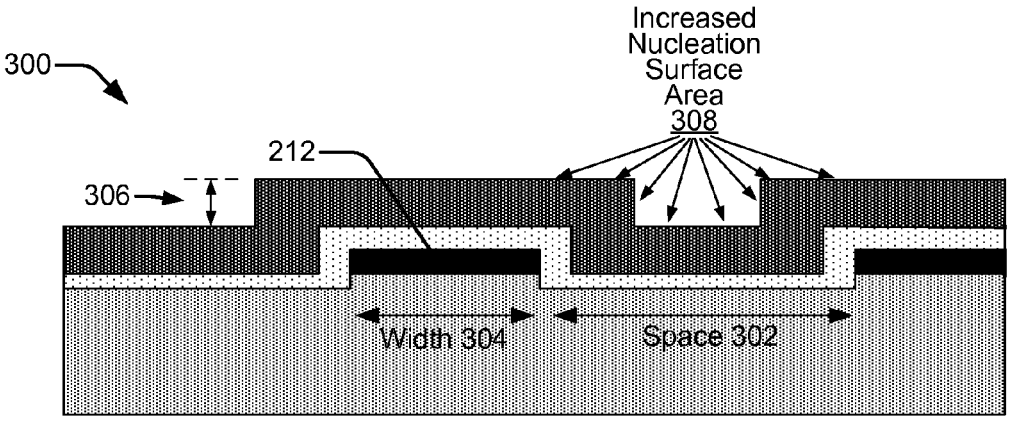
FIG. 3 shows a cross-sectional, blown-up view of an example of a partial three-dimensional resistor structure, according to an embodiment.

FIG. 3 shows a cross-sectional, blown-up view of an example of a partial three-dimensional resistor structure 300, according to an embodiment of the disclosure. The number of resistor elements 212 within a given resistor structure 300 is variable. Although significant improvements in temperature uniformity across the nucleation surface of the resistor structure 300 have been achieved using a resistor structure 300 having 6 or 7 resistor elements 212 (resulting in considerable gains in thermal and electrical efficiency), the number of elements 212 in the structure 300 may vary significantly beyond this range based on the required nucleation surface area as well as the choice of resistor element width, spacing, and height.

Between each resistor element 212 in resistor structure 300 is a space 302. In general, the width 304 of each resistor element 212 and the space 304 between every two elements 212 are variable. The widths of the resistor elements 212 and spaces 302 naturally vary depending on the number of elements 212 present within the structure 300. For example, for a given resistor structure 300 having a particular width, when the number of elements 212 increases within the structure 300, the element widths 304 and/or the spaces 302 between the elements 212 will decrease. In addition, however, the element widths 304 and spaces 302 can also vary on an individual basis across the structure 300 in a manner that is independent of the number of elements 212 in the structure 300. For example, in a resistor structure 300 that includes 7 resistor elements 212, different ones or all of the 7 elements can have widths 304 that vary from one another. Like the individual resistor elements 212, the spaces 302 between resistor elements 212 can also vary on an individual basis across the structure 300 in a manner that is independent of the number of elements 212 in the structure 300. Moreover, each resistor element 212 present in the resistor structure 300 results in a comb tooth formation that has a height 306 that is also variable. Thus, there are three variable dimensions within a resistor structure 300. These include the width of each resistor element 212, the spacing 302 between every two resistor elements 212, and the height 306 of each comb tooth formation associated with each resistor element 212.

In general, variable element widths, spacings and heights across the comb resistor provide a tailored thermal profile. The variable number of resistor elements 212, the variable widths 304 and spacing 302 of the resistor elements 212, and the variable height 306 of the comb teeth, improve thermal energy transfer efficiency between the resistor elements 212 and the fluid 226, and enable a significant degree of control over the temperature distribution across the nucleation surface of the resistor structure 300 such that temperature uniformity can be maximized. More specifically, as is shown in FIG. 3, the three-dimensional resistor structure 300 results in an increased amount of nucleation surface area 308 per the combined area of resistor elements 212, which increases the amount of thermal energy transfer to the fluid 226 (and decreases residual thermal energy losses to the printhead). The increased amount of nucleation surface area 308 and the ability to control its proximity to the active resistor elements 212 (i.e., by varying the widths 304, spacing 302, and height 306 of the comb teeth) provide a great deal of control over the thermal energy distribution and temperature uniformity across the entire surface area of the resistor structure 300.

The particular and relative dimensions of the widths 304 and spacing 302 of the resistor elements 212 and the height 306 of the comb teeth, have varying impact on the fluid drop ejection performance of a drop generator 200 through their contributions to improved thermal efficiency and temperature uniformity across the surface of the resistor structure 300. For example, fluid drop ejection performance (i.e., desired drop weight, drop velocity, drop trajectory, drop shape) tends to improve as the widths 304 and spacing 302 of resistor elements 212 get smaller. Currently, a range of between 0.25 and 3.00 micrometers (um) for both the resistor element 212 width 304 and the spacing 302 of the elements is considered to provide the most significant performance benefits. A current height 306 range considered significant is between 0.25 um and 1.00 um. However, these ranges are not intended to be a limitation, and a wider range (e.g., a lower limit) is contemplated as related fabrication techniques improve. Thus, the fundamental benefits may exist at even smaller dimensions, such as around 0.1 um, for example.

Figure 4A:
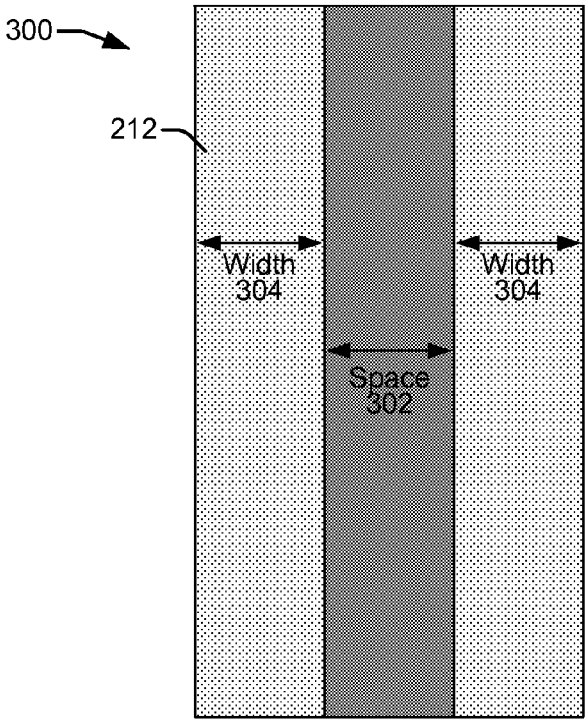
FIGS. 4A, 4B and 4C show top-down views of resistor structures having varying numbers of resistor elements, according to embodiments.
Figure 4B:
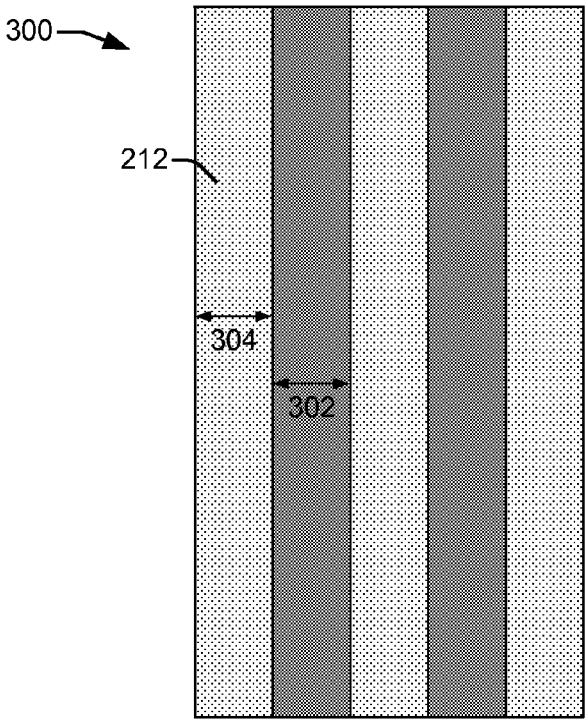
Figure 4C:
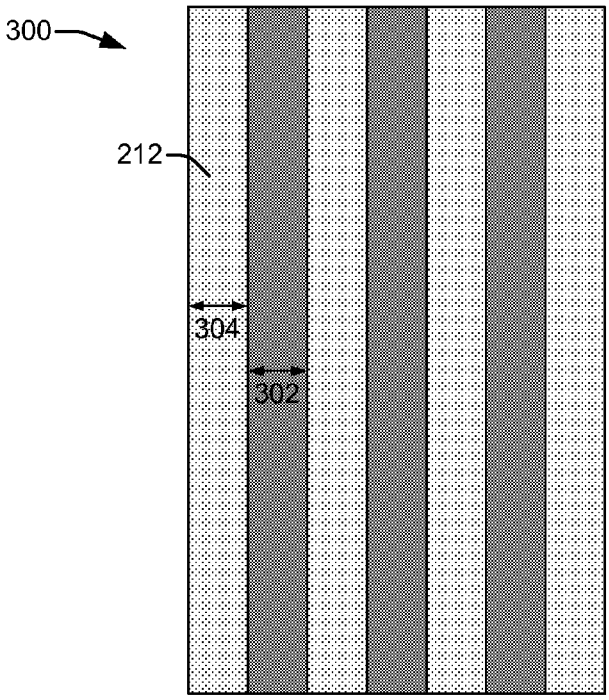

FIGS. 4A, 4B and 4C show top-down views of resistor structures 300 having varying numbers of resistor elements 212, according to embodiments of the disclosure. As indicated above, resistor structures 300 showing particular numbers of resistor elements 212 are only examples and are not intended to indicate a limitation as to the number of elements 212 that can be present in a resistor structure 300. Thus, the number of elements 212 in each structure 300 may vary beyond the examples provided. Accordingly, by way of example, the resistor structure 300 in FIG. 4A has two resistor elements 212. In FIGS. 4B and 4C, the resistor structures 300 have three and four resistor elements 212, respectively. In addition to demonstrating that resistor structures 300 can have a varying number of resistor elements 212, FIGS. 4A-4C are intended to show how the widths 304 of the elements 212 and spaces 304 between elements vary depending on the number or elements 212 present within the structure 300. As the number of resistor elements 212 increases from two to four, the element widths 304 and the spaces 302 between the elements 212 decrease.

Figure 5:
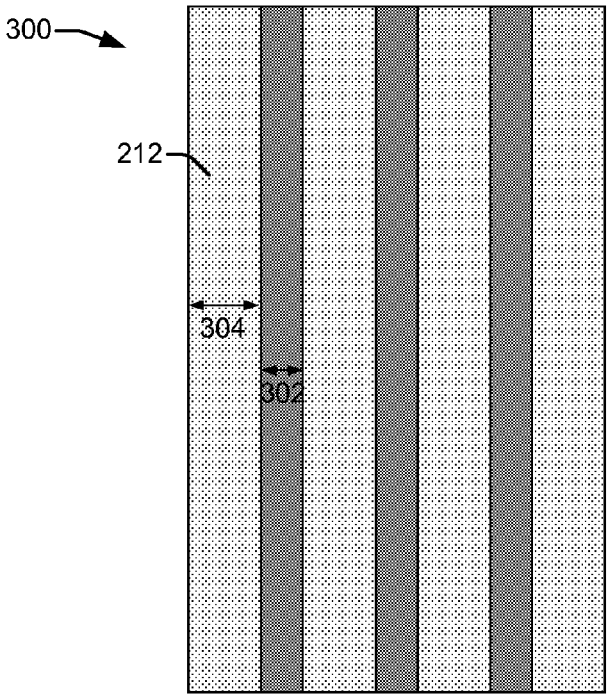
FIG. 5 shows a top-down view of a resistor structure having resistor elements whose widths are not the same size as the spaces between the elements, according to an embodiment.
Figure 6A:
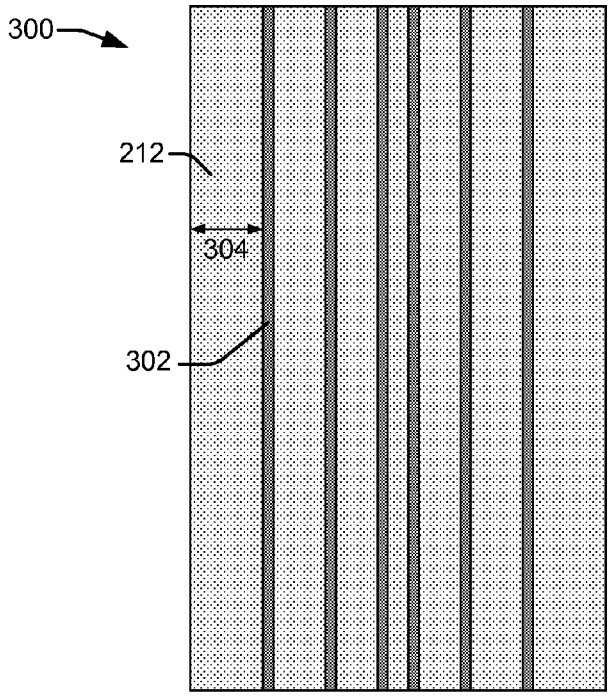
FIGS. 6A, 6B, 6C and 6D, show top-down views of resistor structures with a variety of difference configurations of widths of resistor elements and the spaces between the elements, according to an embodiment.
Figure 6B:
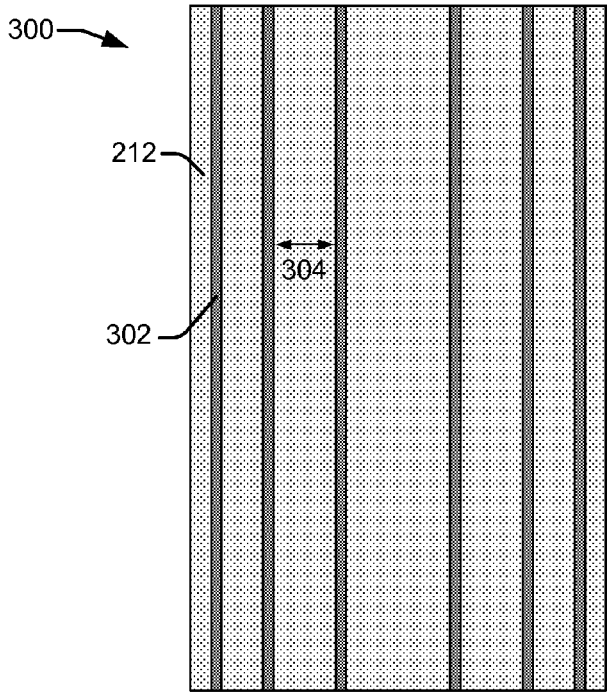
Figure 6C:
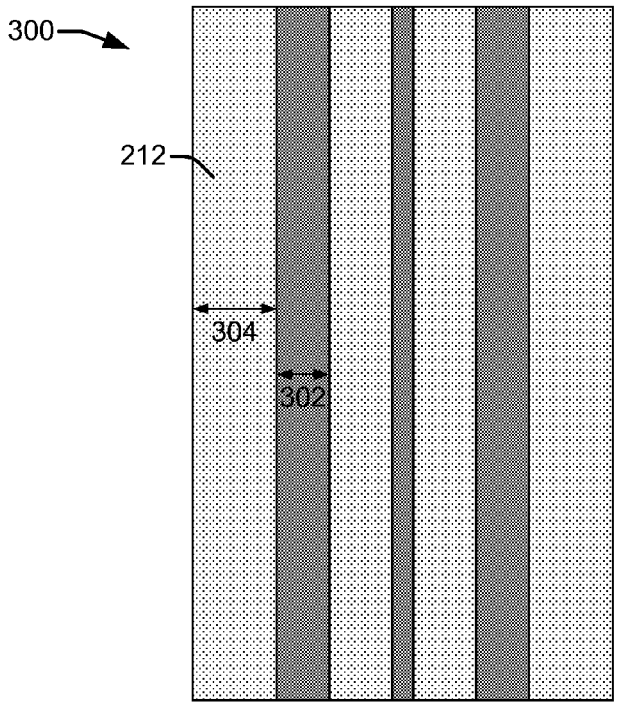
Figure 6D:
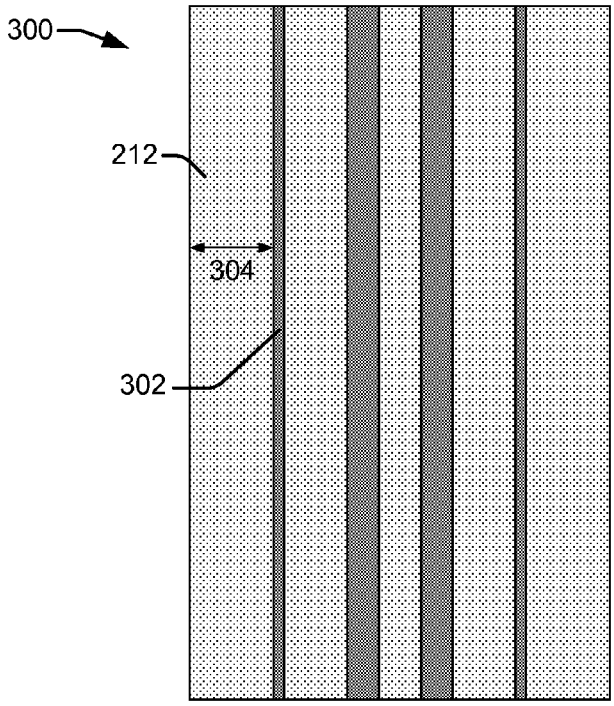

Although the resistor structures 300 in FIGS. 4A-4C show examples where the widths 304 of the elements 212 and spaces 302 are equal, in other embodiments the widths 304 and spaces 302 are not equal. For example, FIG. 5 shows a top-down view of a resistor structure 300 having resistor elements 212 whose widths 304 are not the same size as the spaces 302 between the elements 212, according to an embodiment of the disclosure. In this example, the widths 304 of the elements 212 are equal to one another and the spaces 302 between the elements 212 are equal to one another, but the widths are not equal to the spaces. Specifically, the element widths 304 are wider than the spaces 302. In other embodiments, however, the widths 304 of the elements 212 are narrower than the spaces 302 between the elements.

FIGS. 6A, 6B, 6C and 6D, show top-down views of resistor structures 300 with a variety of difference configurations of widths 304 of resistor elements 212 and the spaces 302 between the elements, according to embodiments of the disclosure. In the embodiment shown in FIG. 6A, seven resistor elements 212 are separated by six spaces 302 across the surface of the resistor structure 300. The widths 304 of the elements 212 are wider toward the edges of the structure 300 and narrower toward the center. The spaces 302 are uniform across the structure 300. In the embodiment shown in FIG. 6B, seven resistor elements 212 are again separated by six spaces 302 across the surface of the resistor structure 300. However, the widths 304 of the elements 212 are narrower toward the edges of the structure 300 and wider toward the center. Again, the spaces 302 are uniform across the structure 300. In the embodiment shown in FIG. 6C, four resistor elements 212 are separated by three spaces 302 across the surface of the resistor structure 300. In this case, both the widths 304 of the elements 212 and the spaces 302 between the elements get narrower toward the center of the structure 300 and wider toward the edge of the structure. In the embodiment shown in FIG. 6D, five resistor elements 212 are separated by four spaces 302 across the surface of the resistor structure 300. In this case, the widths 304 of the elements 212 get narrower toward the center of the structure 300 and wider toward its edges, while the spaces 302 between the elements get wider toward the center of the structure 300 and narrower toward its edges. Accordingly, virtually any configuration of resistor elements 212 and widths 304 and spaces 302 are possible across the resistor structure 300 to achieve optimum temperature uniformity across the structure 300 and optimum thermal energy transfer efficiency between the structure and the fluid 226.

Figure 7A:
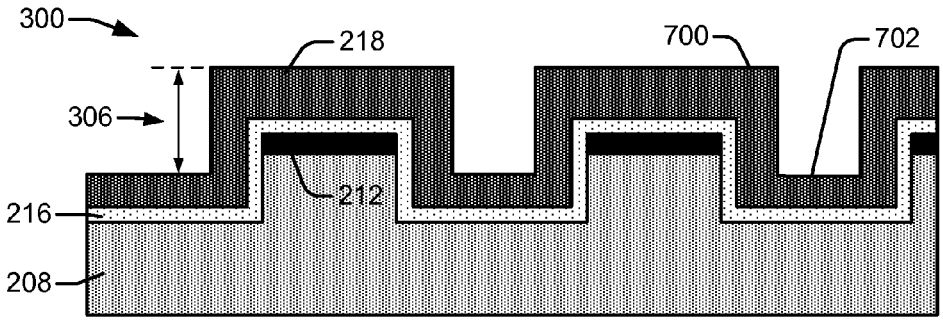
FIGS. 7A, 7B and 7C show cross-sectional views of resistor structures with varying height dimensions of the comb teeth, according to embodiments.
Figure 7B:
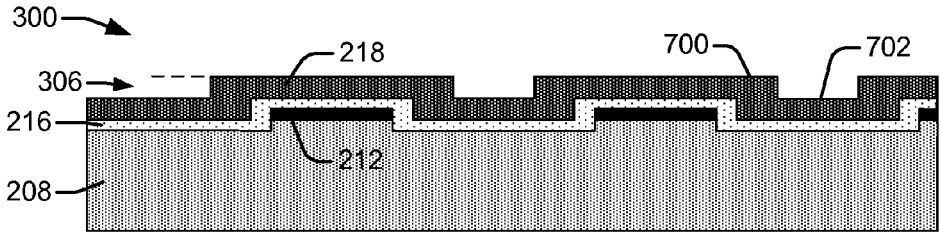
Figure 7C:
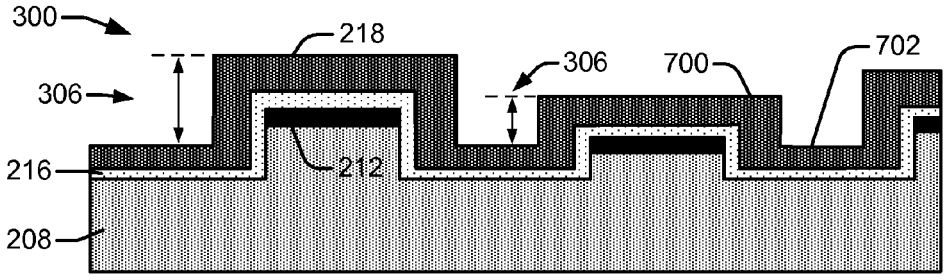

FIGS. 7A, 7B and 7C show cross-sectional views of resistor structures 300 that demonstrate varying height 306 dimensions of the comb teeth, according to embodiments of the disclosure. The height 306 is the distance from the surface of the resistor structure 300 (i.e., surface of tantalum cavitation layer 218) at the top 700 of a comb tooth to the surface of the resistor structure 300 at the bottom 702 of a comb tooth. As with the width 304 and spacing 302 of the resistor elements 212, the height 306 of the comb teeth is variable. Varying the width 304, spacing 302 and height 306 of the comb tooth structure 300 provides control over the amount of nucleation surface area 308 and its proximity (i.e., closeness) to the resistor elements 212. Thus, varying the height 306 dimension also helps optimize temperature uniformity and thermal energy transfer efficiency across the surface of the resistor structure 300. Moreover, limiting or minimizing the height 306 can also be used to help control or dial in the resistor life span.

In the embodiment shown in FIG. 7A, the height 306 of the comb tooth formation of resistor structure 300 is shown to be at an example upper limit, while in the embodiment shown in FIG. 7B, the height 306 is at an example lower limit. As noted above, a current height 306 range between 0.25 um and 1.00 um is considered to provide the most significant performance benefits, but this range is not intended to be a limitation, as benefits may exist using different heights. For example, limiting the height perhaps even down to 0.0 um (i.e., a flat nucleation surface) may have an impact on optimizing resistor life. FIG. 7C shows a resistor structure 300 where the height 306 of the comb teeth vary across the surface of the structure 300. Thus, as the widths 304 and spacing 302 of elements can vary across a particular resistor structure 300, so too can the height 306 of the comb teeth.

Figure 8:
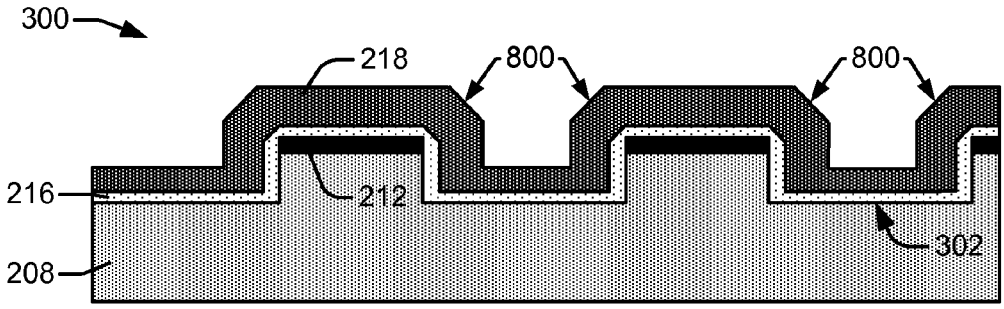
FIG. 8 shows a cross-sectional view of a resistor structure whose comb teeth have beveled corners, according to an embodiment.

FIG. 8 shows a cross-sectional view of a resistor structure 300 whose comb teeth have beveled corners, according to an embodiment of the disclosure. The beveled corners 800 of the comb teeth (i.e., in the surface of tantalum cavitation layer 218) increase the nucleation surface area of the resistor structure 300. In addition, the beveled corners 800 further tailor the proximity of the nucleation surface area around the individual resistor elements 212 in order to provide additional temperature uniformity across the surface of the structure 300. Without the bevels 800, the sharp corners of the comb teeth are farther away from elements 212 and therefore have greater variance in temperature than those areas of the surface that are more uniformly close to the resistor elements 212. As shown in FIG. 8, the contour of the underlying passivation layer 216 can also follow the beveled shape of the corners 800. Furthermore, generally due to thin film deposition processes, the thin films on the steep vertical sidewalls of the comb teeth typically have about one-half the thickness as the films of the top horizontal surface. This difference in film coverage on the vertical sidewalls shortens the thermal path length from the resistor elements 212 to the channels or spaces 302 which helps heat transfer laterally from the elements to the channels spaces 302.

Figure 9:
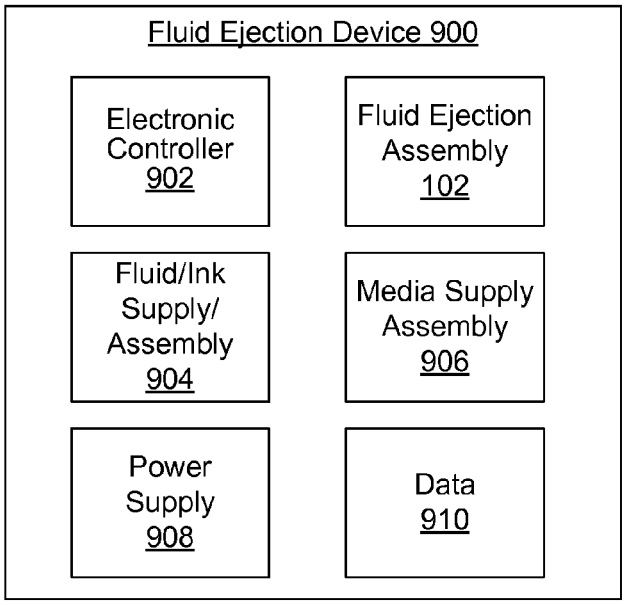
FIG. 9 shows a block diagram of a basic fluid ejection device, according to an embodiment.

FIG. 9 shows a block diagram of a basic fluid ejection device, according to an embodiment of the disclosure. The fluid ejection device 900 includes an electronic controller 902 and a fluid ejection assembly 102. Fluid ejection assembly 102 can be any embodiment of a fluid ejection assembly 102 described, illustrated and/or contemplated by the present disclosure. Electronic controller 902 typically includes a processor, firmware, and other electronics for communicating with and controlling assembly 102 to eject fluid droplets in a precise manner.

In one embodiment, fluid ejection device 900 may be an inkjet printing device. As such, fluid ejection device 900 may also include a fluid/ink supply and assembly 904 to supply fluid to fluid ejection assembly 102, a media transport assembly 906 to provide media for receiving patterns of ejected fluid droplets, and a power supply 908. In general, electronic controller 902 receives data 910 from a host system, such as a computer. The data represents, for example, a document and/or file to be printed and forms a print job that includes one or more print job commands and/or command parameters. From the data, electronic controller 902 defines a pattern of drops to eject which form characters, symbols, and/or other graphics or images.

What is claimed is:

1. A thermal resistor fluid ejection assembly comprising:
an insulating substrate;
first and second electrodes formed on the substrate; and
a plurality of individual resistor elements of varying widths arranged in parallel on the substrate and electrically coupled at a first end to the first electrode and at a second end to the second electrode.

2. A thermal resistor fluid drop ejector as in claim 1, further comprising a space between each two individual resistor elements, each space being of equal width.

3. A thermal resistor fluid drop ejector as in claim 1, further comprising a space between each two individual resistor elements, wherein at least two spaces have unequal widths.

4. A thermal resistor fluid drop ejector as in claim 1, wherein the resistor elements form a resistor structure and the varying widths of the resistor elements are wider toward edges of the resistor structure and are narrower toward the center of the resistor structure.

5. A thermal resistor fluid drop ejector as in claim 4, wherein each comb tooth structure has a height extending from a top of the ridge to a top of the channel.

6. A thermal resistor fluid drop ejector as in claim 5, wherein each comb tooth structure is of equal height.

7. A thermal resistor fluid drop ejector as in claim 5, wherein heights associated with comb tooth structures are not all equal.

8. A thermal resistor fluid drop ejector as in claim 1, wherein the resistor elements form a resistor structure and the varying widths of the resistor elements are narrower toward edges of the resistor structure and are wider toward the center of the resistor structure.

9. A thermal resistor fluid drop ejector as in claim 1, further comprising a three-dimensional comb tooth structure associated with each individual resistor element, each comb tooth structure having a ridge formed over an associated resistor element and a channel formed in a space on either side of the associated resistor element.

10. A thermal resistor fluid drop ejector as in claim 9, wherein corners on each comb tooth structure are beveled.

11. A fluid ejection device comprising:

a fluid ejection assembly having a resistor structure with a plurality of resistor elements; and an uneven nucleation surface having protruding ridges separated by recessed channels and formed as a top layer of the resistor structure to vaporize fluid when heated by the resistor elements, wherein a width of each protruding ridge corresponds with an associated resistor element underlying the nucleation surface.

12. A fluid ejection device as in claim 11, wherein the widths of the protruding ridges are not all equal.

13. A fluid ejection device as in claim 11, further comprising an electronic controller to control the vaporization of fluid by heating the resistor elements in a precise manner according to commands in a print job.

14. A fluid ejection device as in claim 13, further comprising:

a fluid chamber; and a nozzle outlet disposed in the fluid chamber to eject a fluid drop upon vaporization of fluid in the fluid chamber.

15. A thermal resistor structure comprising:

a plurality of resistor elements coupled in parallel and having non-uniform widths;

a space between every two resistor elements; and a thin film layer formed over the resistor elements and the spaces such that a ridge is formed over each resistor element and a channel is formed over each space, the layer forming a nucleation surface to transfer heat from the resistor elements to vaporize fluid in a chamber and eject a fluid drop from the chamber.

16. The thermal resistor structure of claim 15, in which the space between every two resistor elements is of equal width.

17. The thermal resistor structure of claim 15, in which the space between every two resistor elements are of unequal widths.

18. The thermal resistor structure of claim 15, in which the resistor elements are wider toward edges of the resistor structure and are narrower toward the center of the resistor structure.

19. The thermal resistor structure of claim 15, in which the resistor elements are narrower toward edges of the resistor structure and are wider toward the center of the resistor structure.

20. The thermal resistor structure of claim 15, in which every two resistor elements are of unequal heights.

* * * * *